US011459196B2

(12) United States Patent
Fujii

(10) Patent No.: US 11,459,196 B2
(45) Date of Patent: Oct. 4, 2022

(54) DOCUMENT CONVEYING DEVICE AND METHOD OF CONTROLLING A DOCUMENT CONVEYING DEVICE

(71) Applicant: KYOCERA Document Solutions Inc., Osaka (JP)

(72) Inventor: Koji Fujii, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 118 days.

(21) Appl. No.: 17/182,950

(22) Filed: Feb. 23, 2021

(65) Prior Publication Data

US 2021/0261368 A1 Aug. 26, 2021

(30) Foreign Application Priority Data

Feb. 26, 2020 (JP) ..... JP2020-030824

(51) Int. Cl.

| | |
|---|---|
| ***B65H 5/06*** | (2006.01) |
| ***B65H 7/02*** | (2006.01) |
| ***B65H 7/18*** | (2006.01) |
| ***B65H 9/00*** | (2006.01) |
| ***B65H 3/06*** | (2006.01) |

(52) U.S. Cl.

CPC ..... *B65H 5/06* (2013.01); *B65H 3/06* (2013.01); *B65H 7/02* (2013.01); *B65H 7/18* (2013.01); *B65H 9/006* (2013.01); *B65H 2513/10* (2013.01); *B65H 2513/512* (2013.01)

(58) Field of Classification Search

CPC . B65H 3/047; B65H 3/06; B65H 5/06; B65H 5/062; B65H 7/02; B65H 7/04; B65H 7/18; B65H 9/006; B65H 2513/104; B65H 2513/108; B65H 2513/512; B65H 2513/10

See application file for complete search history.

(56) References Cited

U.S. PATENT DOCUMENTS

| | | | | |
|---|---|---|---|---|
| 2004/0223797 | A1* | 11/2004 | Ueda | B65H 7/00 399/388 |
| 2015/0338808 | A1* | 11/2015 | Ishihara | B65H 7/02 399/401 |
| 2016/0152425 | A1* | 6/2016 | Inoue | B65H 7/18 271/10.03 |
| 2018/0267451 | A1* | 9/2018 | Hirano | B65H 7/06 |

FOREIGN PATENT DOCUMENTS

JP 2004-315177 A 11/2004

* cited by examiner

*Primary Examiner* — Prasad V Gokhale
(74) *Attorney, Agent, or Firm* — Stein IP, LLC

(57) ABSTRACT

A controller starts sheet feeding at a primary sheet feeding speed, then momentarily stops a sheet feeding rotary member, and thereafter starts secondary sheet feeding. When the secondary sheet feeding speed equals a first speed, the controller momentarily stops the sheet feeding rotary member such that the leading end of a document sheet stops at a first stop position. When the secondary sheet feeding speed equals a second speed, the controller momentarily stops the sheet feeding rotary member such that the leading end of a document sheet stops at a second stop position. The second stop position is located downstream of the first stop position in the document conveying direction.

12 Claims, 8 Drawing Sheets

FIG.5

D1

| | PRIMARY SHEET FEEDING | SECONDARY SHEET FEEDING | | | |
|---|---|---|---|---|---|
| | | COLOR 300dpi | MONO-CHROME 300dpi | COLOR 600dpi | MONO-CHROME 600dpi |
| SHEET FEEDING ROTARY MEMBERS (FEED MOTOR) | PRIMARY SHEET FEEDING SPEED | 1ST SPEED | 1ST SPEED | 2ND SPEED | 3RD SPEED |
| PAIR OF SECONDARY SHEET FEED ROLLERS (SECONDARY SHEET FEED MOTOR) | — | 1ST SPEED | 1ST SPEED | 2ND SPEED | 3RD SPEED |
| PAIRS OF DOCUMENT CONVEYING ROLLERS (DOCUMENT CONVEYING MOTOR) | — | 1ST SPEED | 1ST SPEED | 2ND SPEED | 3RD SPEED |
| PAIR OF DOCUMENT DISCHARGE ROLLERS (DOCUMENT DISCHARGE MOTOR) | — | 1ST SPEED | 1ST SPEED | 2ND SPEED | 3RD SPEED |

N.B. 1ST SPEED > PRIMARY SHEET FEEDING SPEED > 3RD SPEED > 2ND SPEED

DOCUMENT CONVEYING DEVICE AND METHOD OF CONTROLLING A DOCUMENT CONVEYING DEVICE

INCORPORATION BY REFERENCE

This application is based on and claims the benefit of Japanese Patent Application No. 2020-030824 filed on Feb. 26, 2020, the contents of which are hereby incorporated by reference.

BACKGROUND

The present disclosure relates to a document conveying device that conveys a document toward a reading position.

An image forming apparatus performs a job while conveying a sheet. For example, a sheet may with a delay reach the position at which to put an image on it. A delay in conveying a sheet results in a smaller number of sheets printed per unit time. For example, an excessive interval between sheets may cause a delay in sheet conveyance. A known technology for reducing variation of intervals between sheets works as follows.

A known sheet conveying device includes: a sheet feed roller for feeding out sheets from a sheet stack portion; a separating means for separating a sheet from sheets; a first conveying roller provided downstream of the sheet feed roller; a second conveying roller provided downstream of the first conveying roller; and a conveyance sensor provided downstream of the first conveying roller, for sensing presence of a sheet. When sheets are fed continuously, the time T1 after the trailing end of a preceding sheet passes across the sensor position until the leading end of the subsequent sheet passes across the sensor position is measured, and according to the value of the time T1, the time for which the subsequent sheet is fed at a speed V2 higher than the speed V1 at which the preceding sheet is fed is determined.

Some known devices perform a job based on image data acquired by reading a document. For example, image forming apparatuses includes what is called multifunctional peripherals, of which some are provided with a document reading function. For example, image data acquired by reading a document is used to perform a job such as printing and data transmission. Some known devices feed out one document sheet after another out of a bundle of document sheets and continuously read conveyed document sheets. With these devices, the user does not need to set document sheets one by one. A plurality of document sheets can be read easily and quickly.

The greater the number of sheets read per unit time (the higher productivity, the higher the reading speed), the higher the efficiency of work. A device that boasts a great number of sheets read per unit time brings high productivity. The number of sheets read per unit time can be a selling point of a product. Thus, the specification of a product often states the number of sheets read per unit time, like 100 pages per minute. Here, some devices convey a document at different conveying speeds (linear velocities) in different document reading modes. In these devices, different numbers of sheets read per unit time can be set for different modes. Attaining a set number of sheets read per unit time at whatever conveying speed, however, encounters a challenge of delivering document sheets to the reading position with no delay. At no matter what conveying speed, productivity has to be secured.

The known sheet conveying device mentioned above tries to reduce the sheet-to-sheet intervals by increasing the conveying speed of subsequent sheets. Depending on the mode, the rotation speed of a motor before being increased may already be close to the maximum speed. In that case, the rotation speed of the motor cannot be increased so much as to cancel the delay of a sheet. The known sheet conveying device mentioned above cannot overcome the challenge discussed above. It also suffers from complex control involved in varying on case-by-case basis when to change the conveying speed.

SUMMARY

According to one aspect of the present disclosure, a document conveying device includes a document tray, a sheet feeding rotary member, a secondary sheet feeding roller, and a controller. On the document tray, a document is set. The sheet feeding rotary member feeds a document sheet out of the document set on the document tray. The secondary sheet feeding roller is provided downstream of the sheet feeding rotary member in the document conveying direction. The secondary sheet feeding roller feeds the document sheet toward the reading position. The controller controls the rotation of the sheet feeding rotary member and the secondary sheet feeding roller. When one document sheet after another is fed out of the document set on the document tray toward the reading position, in primary sheet feeding, the controller rotates the sheet feeding rotary member such that the document sheet is fed at a primary sheet feeding speed, and momentarily stops the sheet feeding rotary member before the trailing end of the document sheet leaves the sheet feeding rotary member. In secondary sheet feeding after momentarily stopping the sheet feeding rotary member, the controller rotates the sheet feeding rotary member and the secondary sheet feeding roller such that the document sheet is fed at a secondary sheet feeding speed different from the primary sheet feeding speed. The secondary sheet feeding speed can be a first speed or a second speed lower than the first speed. When the secondary sheet feeding speed equals the first speed, in primary sheet feeding, the controller momentarily stops the sheet feeding rotary member such that the leading end of the document sheet stops at a first stop position. When the secondary sheet feeding speed equals the second speed, in primary sheet feeding, the controller momentarily stops the sheet feeding rotary member such that the leading end of the document sheet stops at a second stop position. The second stop position is located downstream of the first stop position in the document conveying direction.

According to another aspect of the present disclosure, a method of controlling a document conveying device includes: setting a document on a document tray; feeding a document sheet out of the document set on the document tray with a sheet feeding rotary member; feeding the document sheet toward the reading position with a secondary sheet feeding roller provided downstream of the sheet feeding rotary member in the document conveying direction; when feeding one document sheet after another out of the document set on the document tray toward the reading position, in primary sheet feeding, rotating the sheet feeding rotary member such that the document sheet is fed at a primary sheet feeding speed; momentarily stopping the sheet feeding rotary member before the trailing end of the document sheet leaves the sheet feeding rotary member; in secondary sheet feeding after momentarily stopping the sheet feeding rotary member, rotating the sheet feeding rotary member and the secondary sheet feeding roller such that the document sheet is fed at a secondary sheet feeding speed different from the primary sheet feeding speed; the secondary sheet feeding speed being a first speed or a second speed lower than the first speed; when the secondary sheet feeding speed equals the first speed, in primary sheet feeding, momentarily stopping the sheet feeding rotary member such that the leading end of the document sheet stops at a first stop position; when the secondary sheet feeding speed equals the second speed, in primary sheet feeding, momentarily stopping the sheet feeding rotary member such that the leading end of the document sheet stops at a second stop position; and the second stop position being located downstream of the first stop position in the document conveying direction.

This and other features and benefits of what is disclosed herein will become apparent from the description of embodiments which follows.

BRIEF DESCRIPTION OF THE DRAWINGS

FIG. 5 is a diagram showing one example of document conveyance in a registrationless mode according to the embodiment.

DETAILED DESCRIPTION

The present disclosure relates to making a document sheet reach a reading position with no delay and well in time so as to attain a target value of the number of sheets read per unit time irrespective of the conveying speed of the document sheet. This helps secure productivity all the time. An embodiment of the present disclosure will be described below with reference to FIGS. 1 to 9. The following description deals with, as an example of a document conveying device, a multifunctional peripheral 100. The multifunctional peripheral 100 is an image forming apparatus as well. The multifunctional peripheral 100 conveys a set document sheet. The multifunctional peripheral 100 reads the conveyed document sheet to generate image data. Based on the generated image data, the multifunctional peripheral 100 can perform a job such as printing or data transmission. It should however be noted that any features specifically mentioned in the description of the embodiment in terms of structure, arrangement, and the like are merely example for the sake of discussion and are in no way meant to limit the scope of the present disclosure.

(Outline of Multifunctional Peripheral 100)

Figure 1:
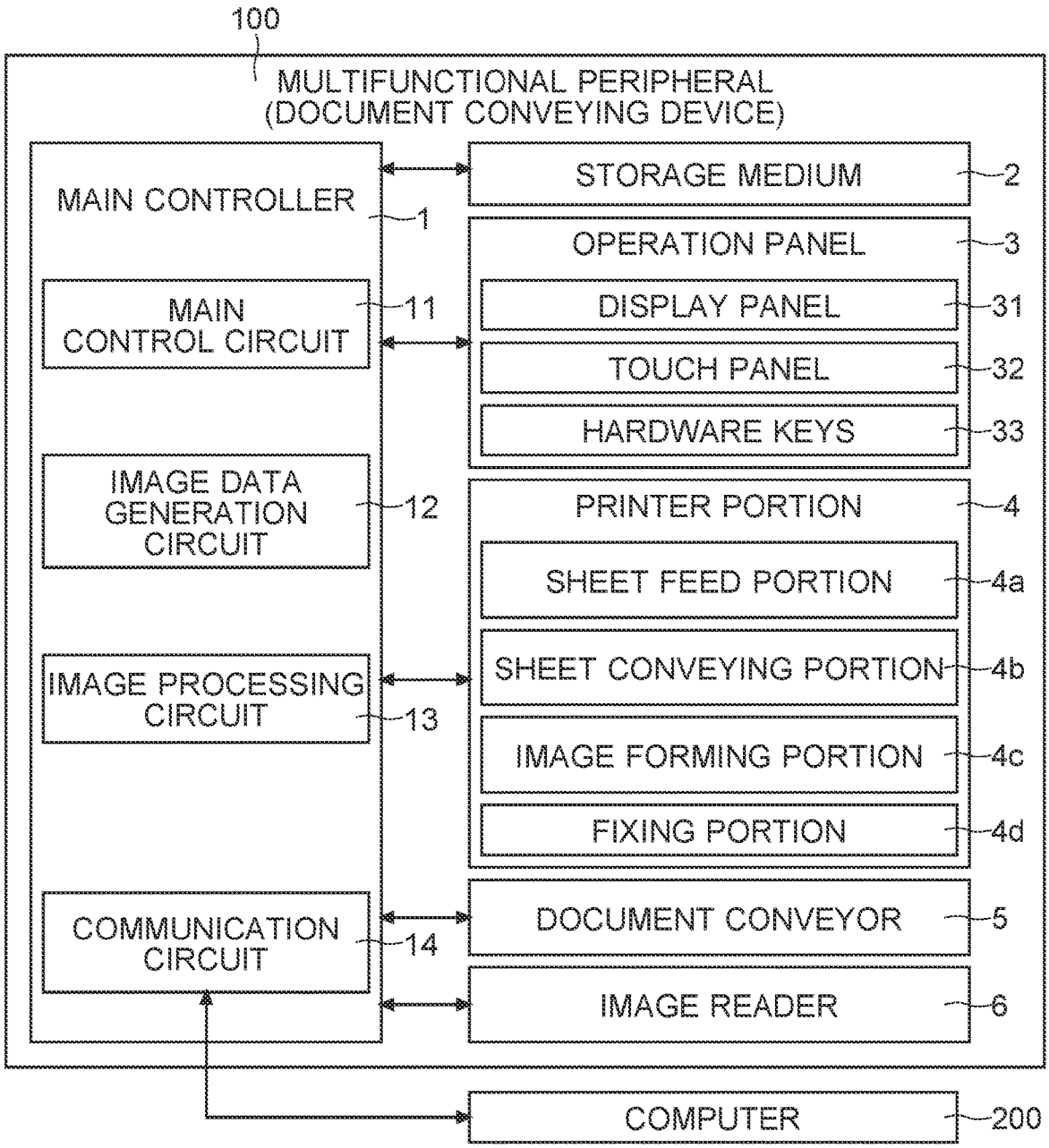
FIG. 1 is a diagram showing a multifunctional peripheral according to an embodiment.

First, with reference to FIG. 1, the multifunctional peripheral 100 according to the embodiment will be described in outline. As shown in FIG. 1, the multifunctional peripheral 100 includes a main controller 1, a storage medium 2, an operation panel 3, a printer portion 4, a document conveyor 5, and an image reader 6.

The main controller 1 controls the operation of the multifunctional peripheral 100. The main controller 1 controls the operation of different blocks in a job such as copying and data transmission. The main controller 1 is a circuit board (main control board) that includes a main control circuit 11, an image data generation circuit 12, an image processing circuit 13, and a communication circuit 14. The main control circuit 11 is, for example, a CPU. The main control circuit 11 performs processing and calculation related to a job.

The image data generation circuit 12 includes a circuit that processes an analog image signal. Based on the analog image signal resulting from the image reader 6 reading a document, the image data generation circuit 12 generates read image data. For example, the image data generation circuit 12 incudes an amplifier circuit, an offset circuit, and an A-D converter circuit. The A-D converter circuit converts into digital data (image data) the analog image signal adjusted by the amplifier circuit and the offset circuit. For example, the image data generation circuit 12 generates gray or color read image data.

The image processing circuit 13 performs image processing on the read image data. The image processing circuit 13 is an ASIC (an integrated circuit designed and developed for image processing). For example, in a copy job, the image processing circuit 13 processes the read image data to generate print output image data. Based on the print output image data, the main controller 1 makes the printer portion 4 perform printing. The communication circuit 14 includes a circuit for communication and a memory for communication. The communication memory stores communication software. The communication circuit 14 communicates with a computer 200. The computer 200 is, for example, a PC or a server. The communication circuit 14 can receive print data from the computer 200. Based on the received print data, the main controller 1 makes the printer portion 4 perform printing (a print job, facsimile reception and printing).

The multifunctional peripheral 100 includes, as the storage medium 2, a RAM, a ROM, and a storage. The storage includes an HDD or an SSD or both. Based on the programs and data stored in the storage medium 2, the main controller 1 controls different blocks.

The operation panel 3 includes a display panel 31, a touch panel 32, and hardware keys 33. The main controller 1 makes the display panel 31 display messages and setting screens. The main controller 1 makes the display panel 31 display also operation-related images. The operation-related images includes, for example, buttons, keys, and tabs. Based on the output from the touch panel 32, the main controller 1 recognizes operated operation-related images. The hardware keys 33 include a Start key and a numerical keypad. The touch panel 32 and the hardware keys 33 accept setting operations (operations related to a job) by the user. By operating the operation-related images and the hardware keys 33, the user can make settings related to a job. The operation panel 3 accepts settings by the user. For example, the operation panel 3 accepts a setting for resolution in document reading. For another example, the operation panel 3 accepts a setting for whether to read in colors or in black and white.

The printer portion 4 includes a sheet feed portion **4*a*, a sheet conveying portion 4*b*, an image forming portion 4*c*, and a fixing portion 4***d*. The sheet feed portion 4*a* includes a sheet feed cassette and a sheet feed roller. The sheet feed cassette stores sheets. The sheet feed roller feeds out sheets. In a print job, the main controller 1 makes the sheet feed portion 4*a* supply sheets. The sheet conveying portion 4*b* includes a pair of sheet conveying rollers and a sheet conveying motor, all for sheet conveyance. The sheet conveying motor rotates the pair of sheet conveying rollers. The pair of sheet conveying rollers conveys sheets. The main controller 1 makes the sheet conveying portion 4*b* convey sheets.

The image forming portion 4*c* includes, for example, a photosensitive drum, a charging device, an exposing device, a developing device, and a transfer roller. The main controller 1 makes the image forming portion 4*c* form a toner image based on image data. The main controller 1 makes the image forming portion 4*c* transfer the toner image to a conveyed sheet. The fixing portion 4*d* includes a heater and a fixing rotary member. The heater heats the fixing rotary member. A sheet is conveyed while in contact with the fixing rotary member. This causes the toner image to be fixed to the sheet. The main controller 1 makes the fixing portion 4*d* fix the transferred toner image to the sheet. The sheet conveying portion 4*b* discharges the printed sheet out of the apparatus.

(Document Conveyor 5 and Image Reader 6)

Next, with reference to FIG. 2, one example of the document conveyor 5 and the image reader 6 according to the embodiment will be described. The multifunctional peripheral 100 includes the document conveyor 5 and the image reader 6. The document conveyor 5 is often called an automatic document reading device (ADF, DP). The combination of the document conveyor 5 and the image reader 6 is arranged, for example, in an upper part of the multifunctional peripheral 100. The document conveyor 5 is provided over the image reader 6.

Figure 2:
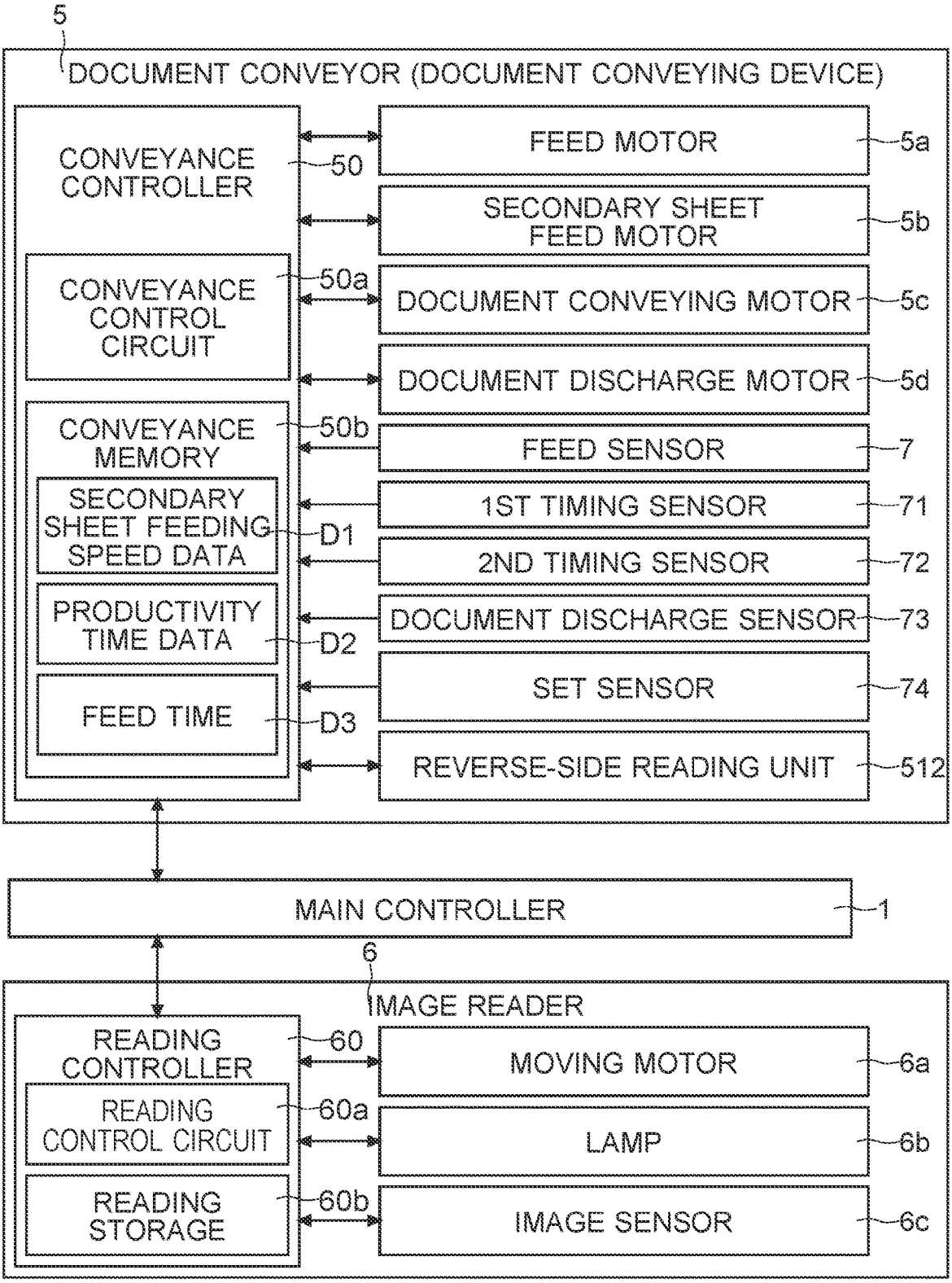
FIG. 2 is a diagram showing one example of a document conveyor and an image reader according to the embodiment.

As shown in FIG. 2, the document conveyor 5 includes a conveyance controller 50 (corresponding to a controller). The conveyance controller 50 is communicably connected to the main controller 1. The conveyance controller 50 includes a conveyance control circuit 50*a* and a conveyance memory 50*b*. For example, the conveyance control circuit 50*a* is a CPU. A ROM and a RAM can be used as the conveyance memory 50*b*. For example, the conveyance controller 50 is a circuit board arranged in the document conveyor 5. In a job involving document reading, the main controller 1 gives the conveyance controller 50 an instruction to convey a sheet. For example, a job involving document reading is a copy job or a data transmission job. Based on the instruction from the main controller 1, the conveyance controller 50 controls the document conveying operation of the document conveyor 5.

The image reader 6 includes a reading controller 60. The reading controller 60 too is communicably connected to the main controller 1. The reading controller 60 includes a reading control circuit 60*a* and a reading storage 60*b*. For example, the reading controller 60 is a CPU. The reading storage 60*b* includes a ROM and a RAM. For example, the reading controller 60 is a circuit board arranged in the image reader 6. In a job involving document reading, the main controller 1 gives the reading controller 60 an instruction to read a document. Based on the instruction from the main controller 1, the reading controller 60 controls document reading operation. Specifically, the reading controller 60 controls the operation of a moving motor 6*a*, a lamp 6*b*, and an image sensor 6*c* (line sensor).

Figure 3:
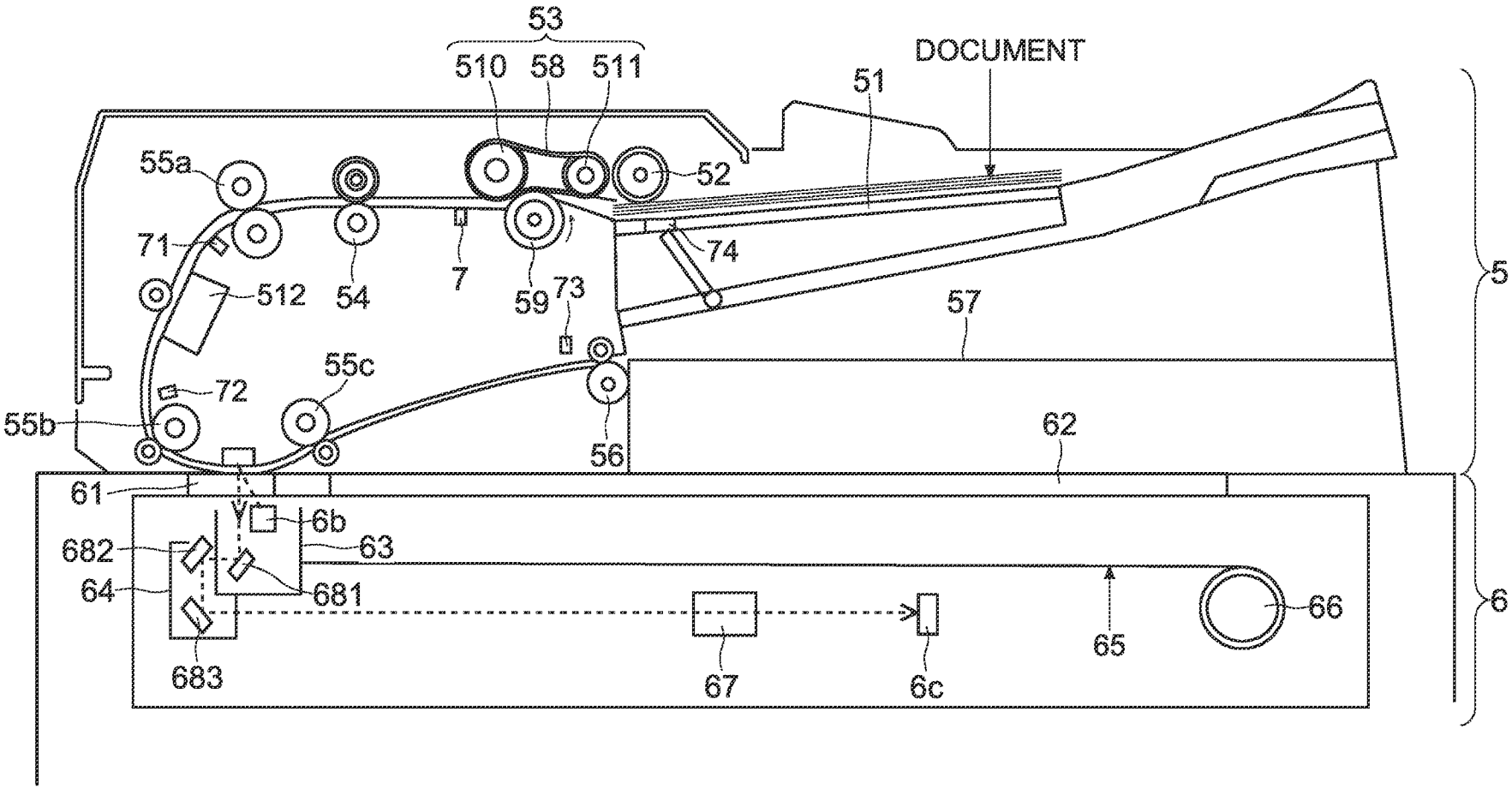
FIG. 3 is a diagram showing one example of the document conveyor and the image reader according to the embodiment.

As shown in FIG. 3, on the top face of the image reader 6, there are provided a feed-reading contact glass 61 and a table-reading contact glass 62. The document conveyor 5, at the near side of the multifunctional peripheral 100, opens and closes in the up-down direction. When setting a document on the table-reading contact glass 62, the user lifts up the document conveyor 5. The document conveyor 5 functions as a pressing cover that presses against the contact glasses in the image reader 6 from above. On the other hand, when a document is set on a document tray 51, the document conveyor 5 conveys the document toward the feed-reading contact glass 61 in the image reader 6.

As shown in FIG. 3, the document conveyor 5 includes, arranged in order from upstream to downstream in the document conveying direction, a document tray 51, a sheet feed roller 52, a separating feeding portion 53, a feed sensor 7, a pair of secondary sheet feed rollers 54, a pair of first document conveying rollers 55*a*, a first timing sensor 71, a reverse-side reading unit 512, a second timing sensor 72, a pair of second document conveying rollers 55*b*, a pair of third document conveying rollers 55*c*, a document discharge sensor 73, a pair of document discharge rollers 56, and a document discharge tray 57. The user sets on the document tray 51 a document (a bundle of document sheets) that he or she wants to read.

To rotate the rotary members in the document conveyor 5, the document conveyor 5 includes a feed motor 5*a* (document feed motor), a secondary sheet feed motor 5*b*, a document conveying motor 5*c*, and a document discharge motor 5*d*. The conveyance controller 50 turns on and off, and controls the rotation speeds of, the feed motor 5*a*, the secondary sheet feed motor 5*b*, the document conveying motor 5*c*, and the document discharge motor 5*d*.

The document tray 51 is provided with a set sensor 74. The set sensor 74 is a sensor for sensing whether a document is set (placed) on the document tray 51. The output level of the set sensor 74 differs according to whether a document is set. The output of the set sensor 74 is fed to the conveyance controller 50. Based on the output of the set sensor 74, the conveyance controller 50 recognizes whether a document is present on the document tray 51. The conveyance controller 50 notifies the main controller 1 whether a document is present. The main controller 1 recognizes whether a document is set on the document tray 51.

The document conveyor 5 feeds out and conveys one sheet after another out of the document on the document tray 51. The document conveyor 5 feeds out document sheets automatically and continuously while keeping intervals between them. Eventually the document sheets are discharged onto the document discharge tray 57. In the middle of the document conveyance passage (between the pair of second document conveying rollers 55*b* and the pair of third document conveying rollers 55*c*), the feed-reading contact glass 61 is located. Right over the feed-reading contact glass 61 is the reading position in feed-reading. In feed-reading, the main controller 1 makes the image reader 6 read the document sheets that pass across the feed-reading contact glass 61.

The document conveyor 5 includes, as sheet feeding rotary members, the sheet feed roller 52 and the separating feeding portion 53. The sheet feed roller 52 is provided at a position where it is in contact with a downstream-side end part of the document set on the document tray 51. The feed motor 5*a* rotates the sheet feed roller 52. In feed-reading, the conveyance controller 50 makes the feed motor 5*a* rotate. The sheet feed roller 52 rotates to feed document sheets out of the document tray 51. The separating feeding portion 53 includes a sheet feed belt 58, a driving roller 510, a driven roller 511, and a separating roller 59. The sheet feed belt 58 is stretched between the driving roller 510 and the driven roller 511. The sheet feed belt 58 moves around in such a direction as to feed document sheets downstream. The feed motor 5*a* also rotates the driving roller 510. Thus, the sheet feed belt 58 moves around in such a direction as to feed document sheets downstream. The separating roller 59 is provided at a position opposite the sheet feed belt 58. The feed motor 5*a* also rotates the separating roller 59.

It can happen that two or more document sheets are conveyed overlapping each other (multiple feeding). Sheets may completely overlap each other, or part of a preceding sheet may overlap part of the subsequent sheet. The separating roller 59 rotates in such a direction as to move document sheets back to the document tray 51. When multiple feeding occurs, the separating roller 59 separates document sheets. Any document sheets beneath the top one are fed back toward the document tray 51. The rotary shaft of the separating roller 59 is fitted with a torque limiter. The torque limiter permits the separating roller 59 to rotate in such a direction as to feed a document sheet downstream when it is the only one that is being conveyed.

Between the separating feeding portion 53 and the pair of secondary sheet feed rollers 54, the feed sensor 7 is provided. In other words, the feed sensor 7 is provided downstream of the sheet feeding rotary member (separating feeding portion 53) in the document conveying direction, upstream of the pair of secondary sheet feed rollers 54 in the document conveying direction. For example, the feed sensor 7 is provided near the exit of the separating feeding portion 53. The feed sensor 7 senses arrival of the leading end, and departure of the trailing end, of a fed document sheet. The feed sensor 7 is, for example, an optical sensor. The feed sensor 7 yields different output levels according to whether it is sensing the presence of a document sheet or not. The output of the feed sensor 7 is fed to the conveyance controller 50. Based on the output of the feed sensor 7, the conveyance controller 50 can recognize the leading end of a document sheet having reached the feed sensor 7. Based on the output of the feed sensor 7, the conveyance controller 50 can also recognize a document sheet passing across the feed sensor 7. Based on the output of the feed sensor 7, the conveyance controller 50 can also recognize the trailing end of a document sheet having passed across (left) the feed sensor 7.

The pair of secondary sheet feed rollers 54 and the pairs of document conveying rollers convey document sheets downstream. The pair of secondary sheet feed rollers 54 is provided downstream of the sheet feeding rotary member (separating feeding portion 53) in the document conveying direction. The pair of secondary sheet feed rollers 54 feeds a document sheet toward its reading position. The secondary sheet feed motor 5*b* rotates the pair of secondary sheet feed rollers 54. The document conveying motor 5*c* rotates the pairs of document conveying rollers. Near a document discharge opening (at the terminal end of the document conveyance passage), the pair of document discharge rollers 56 is provided. The pair of document discharge rollers 56 discharges the read document sheet onto the document discharge tray 57. The document discharge motor 5*d* rotates the pair of document discharge rollers 56. When conveying a document sheet, the conveyance controller 50 drives the secondary sheet feed motor 5*b*, the document conveying motor 5*c*, and the document discharge motor 5*d* to rotate.

Between the pair of first document conveying rollers 55*a* and the pair of second document conveying rollers 55*b*, the first timing sensor 71 and the reverse-side reading unit 512 are provided. The first timing sensor 71 is provided upstream of the reverse-side reading unit 512 in the document conveying direction. In a two-side reading job, the reverse-side reading unit 512 reads the reverse side of the conveyed document sheet. Whether to read only one side (obverse side) of a document sheet or both sides of it can be set on the operation panel 3. The reverse-side reading unit 512 is a reading unit of a CIS type. Providing the reverse-side reading unit 512 permits the obverse and reverse sides of a document sheet to be read in a single session of conveyance. The reverse-side reading unit 512 includes a lamp, a lens, and an image sensor (line sensor). The image sensor in the reverse-side reading unit 512 outputs an analog image signal. The analog image signal is fed to the image data generation circuit 12. In a job involving reading both sides of a document sheet, the image data generation circuit 12 generates image data of the reverse side of the document sheet.

Between the reverse-side reading unit 512 and the pair of first document conveying rollers 55*a*, the first timing sensor 71 is provided. The first timing sensor 71 is, for example, an optical sensor. The first timing sensor 71 yields different output levels according to whether it is sensing the presence of a document sheet or not. The output of the first timing sensor 71 is fed to the conveyance controller 50. Based on the output of the first timing sensor 71, the conveyance controller 50 can recognize the leading end of a document sheet to have reached the first timing sensor 71. When reading both sides of a document sheet, the conveyance controller 50 makes the reverse-side reading unit 512 start reading when a previously determined reverse-side wait time passes after the leading end of the document sheet is recognized to have reached the first timing sensor 71. The conveyance controller 50 uses the first timing sensor 71 to determine when to start reading the reverse side. Instead, the reading controller 60 in the image reader 6 may control the reading by the reverse-side reading unit 512. In that case, the output of the first timing sensor 71 is fed to the reading controller 60. When reading both sides of a document sheet, the reading controller 60 makes the reverse-side reading unit 512 start reading when the reverse-side wait time passes after the leading end of the document sheet is recognized to have reached the first timing sensor 71.

Next, the image reader 6 will be described. As shown in FIG. 3, the image reader 6 includes, inside a casing, a first movable frame 63, a second movable frame 64, a wire 65, a winding drum 66, a lens 67, and an image sensor 6*c*. The first movable frame 63 includes a lamp 6*b*, for shining light onto a document sheet, and a first mirror 681. The second movable frame 64 includes a second mirror 682 and a third mirror 683. The lamp 6*b* is a linear light source that emits light in the main scanning direction. The lamp 6*b* includes, for example, one or more LEDs.

A plurality of wires 65 are fitted to the first and second movable frames 63 and 64. For the sake of convenience, FIG. 3 shows only one wire 65. The other end of the wire 65 is connected to the winding drum 66. The moving motor 6*a* rotates the winding drum 66. The moving motor 6*a* can rotate in forward and reverse directions. The first and second movable frames 63 and 64 can be moved freely in the horizontal direction (the sub scanning direction, the left-right direction in FIG. 3). The position irradiated by the lamp 6*b* can be moved. That is, the position of the reading line can be moved.

The operation panel 3 accepts an instruction to start performing a job. When an instruction to start performing a job involving reading a document is entered, the main controller 1 checks whether a document is set on the document tray 51. If a document is set, the main controller 1 makes the document conveyor 5 and the image reader 6 perform feed-reading. More specifically, the main controller 1 makes the document conveyor 5 convey a document sheet. The main controller 1 also makes the image reader 6 read the document sheet passing across the feed-reading contact glass 61. In this case, the reading controller 60 keeps the first and second movable frames 63 and 64 at a position under the feed-reading contact glass 61.

If no document is set on the document tray 51. The main controller 1 makes the image reader 6 read (perform table-reading on) a document set on the table-reading contact glass 62. In this case, the reading controller 60 moves the first and second movable frames 63 and 64 in the sub scanning direction. The main controller 1, however, does not make the document conveyor 5 convey document sheets.

Downstream of the reverse-side reading unit 512, upstream of the pair of second document conveying rollers 55*b*, the second timing sensor 72 is provided. For example, the second timing sensor 72 is an optical sensor. The second timing sensor 72 yields different output levels according to whether it is sensing the presence of a document sheet or not. The output of the second timing sensor 72 is fed to the conveyance controller 50 and the reading controller 60. Based on the output of the second timing sensor 72, the conveyance controller 50 and the reading controller 60 recognize the leading end of a document sheet having reached the second timing sensor 72. The reading controller 60 makes the image sensor 6*c* start reading when a previously determined obverse-side wait time passes after the leading end of the document sheet is recognized to have reached the second timing sensor 72. The reading controller 60 changes the obverse-side wait time in accordance with the conveying speed of the document sheet. The reading controller 60 uses the second timing sensor 72 to determine when to start reading the obverse side of a document sheet.

When reading a document, the reading controller 60 lights the lamp 6*b*. The lamp 6*b* irradiates the document. The first, second, and third mirrors 681, 682, and 683 direct the light reflected from the document through the lens 67 to the image sensor 6*c*. The image sensor 6*c* is a line sensor. The image sensor 6*c* is capable of reading in colors. The image sensor 6*c* reads the document line by line. The light-receiving elements of the image sensor 6*c* output an analog image signal that reflects the amount of light they receive. The analog image signal from the light-receiving elements is fed to the image data generation circuit 12. Based on the analog image signal fed to it, the image data generation circuit 12 generates read image data.

(Registration Mode and Registrationless Mode)

Figure 4:
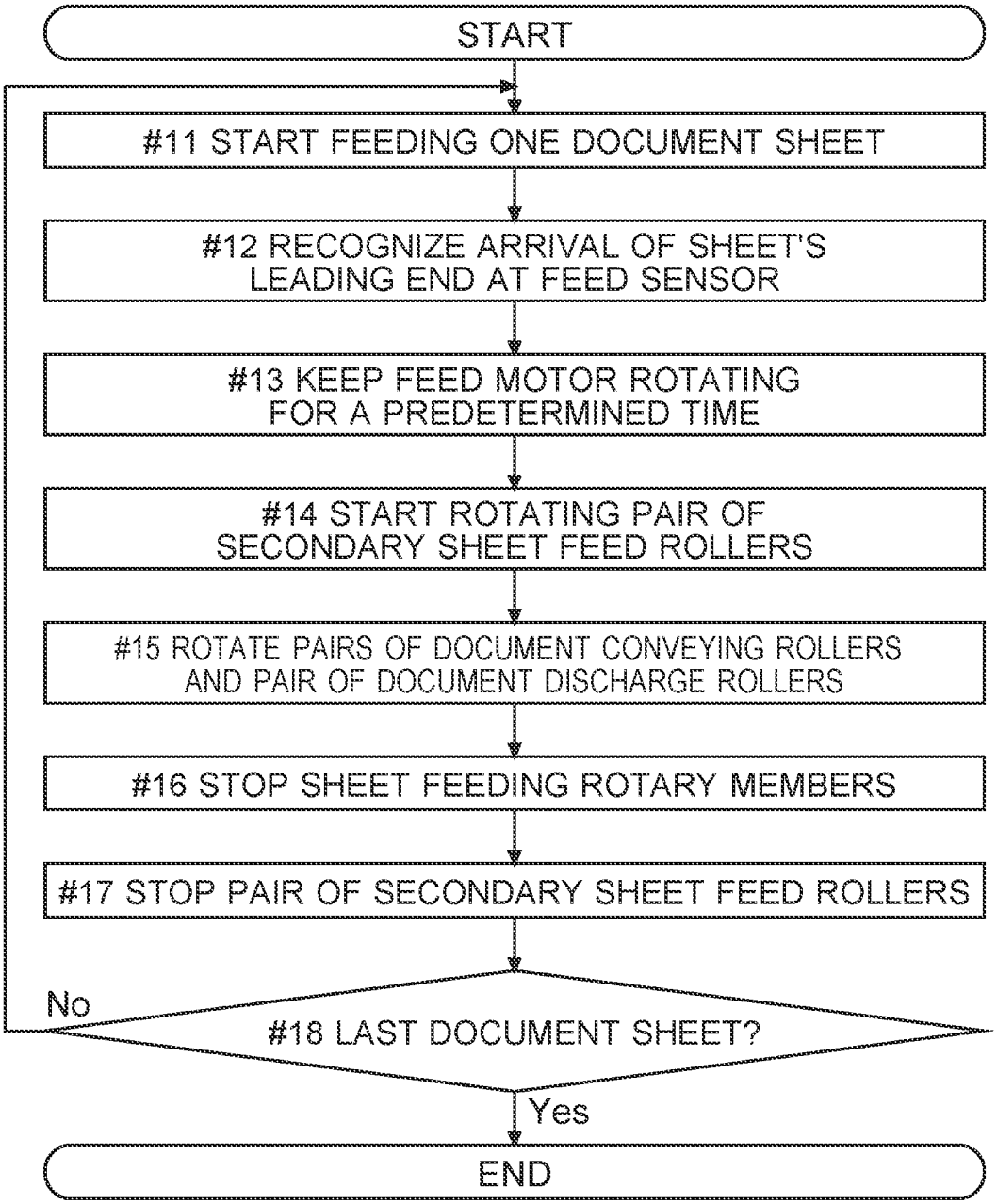
FIG. 4 is a diagram showing one example of document conveyance in a registration mode according to the embodiment.

Next, with reference to FIGS. 4 and 5, one example of document conveyance in a registrationless mode according to the embodiment will be described. The multifunctional peripheral 100 allows choice between a registration mode and a registrationless mode as modes of feed-reading. The operation panel 3 accepts choice of which of the registration mode and the registrationless mode to use. The user chooses the mode that he or she wants to use in feed-reading.

The registration mode is a mode where a document sheet is thrust against the pair of secondary sheet feed rollers 54 to make it sag, thereby to correct skewed feeding of the document sheet. On the other hand, the registrationless mode is a mode where a document sheet is not thrust against any of the pair of secondary sheet feed rollers 54 and the pairs of document conveying rollers. The registrationless mode is thus a mode where skewed feeding of the document sheet is not corrected. The registrationless mode is a mode that helps save the time for skewed feeding correction. In the registrationless mode, the number of sheets read by feed-reading per unit time as stated on the specification is greater than that in the registration mode. In the following description, the number of sheets read by feed-reading per unit time as stated on the specification (as designed) is referred to as the target value.

First, with reference to FIG. 4, one example of the flow of document conveyance in the registration mode will be described. The flow of FIG. 4 starts when feed-reading of a document starts in the registration mode. This is, for example, when the user having set a document on the document tray 51 operates the Start button on the operation panel 3.

The conveyance controller 50 starts to feed one document sheet (step #11). The conveyance controller 50 rotates the feed motor 5*a*. At this point, the conveyance controller 50 keeps the pair of secondary sheet feed rollers 54 at a standstill. Based on the output of the feed sensor 7, the conveyance controller 50 recognizes the leading end of the document sheet having reached the feed sensor 7 (step #12). After recognizing the leading end to have reached the feed sensor 7, the conveyance controller 50 keeps the feed motor 5*a* rotating for a predetermined length of time (step #13). The predetermined length of time is the time required, after the leading end is recognized to have reached the feed sensor 7, to convey the document sheet over a distance for skewed feeding correction. Let a be the distance from the document sense position of the feed sensor 7 to the nip of the pair of secondary sheet feed rollers 54. Let $\beta$ be the distance across which a document sheet is conveyed to make it sag. Then the distance for skewed feeding correction equals $\alpha+\beta$. Conveying a sheet for a predetermined time causes its leading end (a downstream-side end part in the conveying direction) to strike the pair of secondary sheet feed rollers 54. The elasticity of the sagging sheet allows its leading end to fit along the nip of the pair of secondary sheet feed rollers 54. Thus, skewed feeding is corrected.

After the feed motor 5*a* has rotated for the predetermined time, the conveyance controller 50 starts to rotate the secondary sheet feed motor 5*b*, and thereby starts to rotate the pair of secondary sheet feed rollers 54 (step #14). The conveyance controller 50 also rotates the pairs of document conveying rollers and the pair of document discharge rollers 56 (step #15). That is, the conveyance controller 50 also rotates the document conveying motor 5*c* and the document discharge motor 5*d*. The conveyance controller 50 rotates those motors such that the document sheet is conveyed at a predetermined conveying speed. The conveyance controller 50 may keep rotating the document conveying motor 5*c* and the document discharge motor 5*d* after document sheets start to be conveyed until the trailing end of the last document sheet leaves the document discharge sensor 73 (except when a jam is occurring).

On the other hand, for the feed motor 5*a*, the conveyance controller 50 stops its rotation when, or before, the trailing end of a document sheet leaves the feed sensor 7, thereby to stop the sheet feeding rotary members (the sheet feed roller 52 and the separating feeding portion 53) (step #16). This prevents the subsequent sheet from being fed out immediately after the preceding one. Thereafter, the conveyance controller 50 stops the rotation of the secondary sheet feed motor 5*b*, thereby to stop also the pair of secondary sheet feed rollers 54 (step #17). The purpose is to thrust the subsequent sheet against the pair of secondary sheet feed rollers 54. For example, the conveyance controller 50 stops the secondary sheet feed motor 5*b* when the conveying distance after the pair of secondary sheet feed rollers 54 started to rotate exceeds the distance from the nip in the pair of first document conveying rollers 55*a* to the nip in the pair of secondary sheet feed rollers 54. In other words, the conveyance controller 50 stops the secondary sheet feed motor 5*b* after the pair of first document conveying rollers 55*a* starts to pull a sheet. For example, the conveyance controller 50 may stop the secondary sheet feed motor 5*b* when the trailing end of a document sheet has passed across the feed sensor 7.

Then the conveyance controller 50 checks whether the last document sheet out of a bundle of document sheets has been fed out (step #18). For example, the conveyance controller 50 checks the output level of the set sensor 74. If the output level is one that indicates absence of a document sheet, the conveyance controller 50 recognizes that the last document sheet has been fed out. If the output level is one that indicates presence of a document sheet, the conveyance controller 50 recognizes that the last document sheet has not been fed out (there still remain document sheets).

When the last document sheet is judged not to have been fed out (step #18, "No"), the conveyance controller 50 executes step #11 (returns to step #11). When the last document sheet is judged to have been fed out (step #18, "Yes"), the conveyance controller 50 ends document conveyance ("END"). For example, when the last document sheet is discharged onto the document discharge tray 57, the conveyance controller 50 stops all the motors.

Next, the registrationless mode will be described. The registrationless mode can be understood as a mode that offers higher productivity than the registration mode. In the registrationless mode, the conveyance controller 50 starts to rotate the pair of secondary sheet feed rollers 54 (the secondary sheet feed motor 5*b*) at constant intervals (periods). For example, reading 120 sheets per minute can be achieved if the conveyance controller 50 starts to rotate the pair of secondary sheet feed rollers 54 once in 0.5 seconds. Within 0.5 seconds after the pair of secondary sheet feed rollers 54 started to rotate, the conveyance controller 50 stops the pair of secondary sheet feed rollers 54. Sheets are fed out from the pair of secondary sheet feed rollers 54 with a constant rhythm.

In the registrationless mode, primary sheet feeding and secondary sheet feeding are performed. Between primary and secondary sheet feeding, the conveyance controller 50 momentarily stops document conveyance. Primary sheet feeding denotes feeding (conveyance) of a document sheet before a stop, and secondary sheet feeding denotes feeding (conveyance) of a document sheet after the stop (details will be given later). In the following description, the document conveying speed in primary sheet feeding is referred to as the primary sheet feeding speed V0, and the document conveying speed in secondary sheet feeding is referred to as the secondary sheet feeding speed. After the start of secondary sheet feeding, the document sheet is conveyed at the secondary sheet feeding speed. The secondary sheet feeding speed varies with the combination of the set value for reading resolution and the set value for color or monochrome. On the other hand, irrespective of the combination, the primary sheet feeding speed V0 is constant. For example, the conveyance memory 50*b* (ROM) stores, on a nonvolatile basis, secondary sheet feeding speed data D1 in which are defined secondary sheet feeding speeds corresponding to selectable resolution and color settings. FIG. 5 is a diagram showing one example of the secondary sheet feeding speed data D1.

The image reader 6 and the reverse-side reading unit 512 are compatible with several values for reading resolution. For example, the image reader 6 and the reverse-side reading unit 512 are capable of reading at 300 dpi or 600 dpi. The operation panel 3 accepts a setting for reading resolution. Twice a given resolution along each of the vertical and horizontal axes corresponds to four times the amount of data. Reading at 600 dip takes longer than reading at 300 dpi.

Reading in colors produces R (red) image data, G (green) image data, and B (blue image data. Reading in black and white produces grey image data. Some sensors read one line by performing reading for each of R, G, and B (just three times as much operation as in reading in black and white). The greater number of color components results in longer time in color reading than in monochrome reading.

As shown in FIG. 5, for reading in colors at 300 dpi and for reading in black and white at 300 dpi, the secondary sheet feeding speed is set at a first speed V1. For reading in colors at 600 dpi, the secondary sheet feeding speed is set at a second speed V2. For reading in black and white at 600 dpi, the secondary sheet feeding speed is set at a third speed.

The secondary sheet feeding speed is determined with consideration given to the amount of image data processed and the time required in reading. It is defined, in the document conveyor 5 (multifunctional peripheral 100), such that First Speed V1>Primary Sheet Feeding Speed V0>Third Speed>Second Speed V2. For example, the first speed V1 is about 750 to 800 mm/s. For example, the primary sheet feeding speed V0 is about 600 to 700 mm/s. For example, the second speed V2 is about 250 to 350 mm/s. For example, the third speed is a speed higher than the second speed V2 by about 30 to 150 mm/s. At the secondary sheet feeding speed, a document sheet reaches the reading position (the reverse-side reading unit 512, the feed-reading contact glass 61). Accordingly, the higher the secondary sheet feeding speed, the higher productivity. Thus, Target Value at The First Speed V1>Target Value at Third Speed>Target Value at Second Speed V2.

(Conveyance in Registrationless Mode)

Next, with reference to FIGS. 6 to 9, one example of document conveyance in the registrationless mode on the multifunctional peripheral 100 according to the embodiment will be described. In feeding one document sheet after another out of a document set on the document tray 51 toward the reading position (the feed-reading contact glass 61) in the registrationless mode, the conveyance controller 50 performs primary sheet feeding and then momentarily stops document conveyance. In primary sheet feeding, the conveyance controller 50 rotates the feed motor 5*a* such that the document sheet is fed at the primary sheet feeding speed V0 and thereby rotates the sheet feeding rotary members (the sheet feed roller 52 and the sheet feed belt 58). Before the trailing end of the document sheet leaves the sheet feeding rotary members (the sheet feed belt 58), the conveyance controller 50 momentarily stops the feed motor 5*a* and thereby momentarily stops the sheet feeding rotary members.

After the momentary stop, the conveyance controller 50 rotates the sheet feeding rotary members and the pair of secondary sheet feed rollers 54 to start secondary sheet feeding. In secondary sheet feeding, the conveyance controller 50 rotates the sheet feeding rotary members and the pair of secondary sheet feed rollers 54 such that the document sheet is fed at the secondary sheet feeding speed. The secondary sheet feeding speed differs from the primary sheet feeding speed V0.

The secondary sheet feeding speed can be the first speed V1 or the second speed V2, the latter being lower than the former. When the secondary sheet feeding speed equals the first speed V1, the conveyance controller 50, in primary sheet feeding, momentarily stops the sheet feeding rotary members so that the leading end of the document sheet stops at a first stop position P1. When the secondary sheet feeding speed equals the second speed V2, the conveyance controller 50, in primary sheet feeding, momentarily stops the sheet feeding rotary members so that the leading end of the document sheet stops at a second stop position P2. The second stop position P2 is located downstream of the first stop position P1 in the document conveying direction.

Based on the selected resolution and color settings, the conveyance controller 50 determines the secondary sheet feeding speed and the intervals at which to start secondary sheet feeding. When the secondary sheet feeding speed equals the first speed V1, the conveyance controller 50 starts secondary sheet feeding every time a first productivity time passes. When the secondary sheet feeding speed equals the second speed V2, the conveyance controller 50 starts secondary sheet feeding every time a second productivity time passes. The first speed V1 is higher than the second speed V2. The target value at the second speed V2 is smaller than the target value at the first speed V1. Accordingly, the first productivity time is shorter than the second productivity time. To measure intervals (time), the conveyance controller 50 may include a timer circuit that counts time. The conveyance control circuit 50*a* may count time.

The conveyance controller 50 takes as the first productivity time the time resulting from dividing a unit time by a first target value. The first target value is the target value (the number of document sheets read per unit time as stated on the specification) at the first speed V1. The conveyance controller 50 takes as the second productivity time the time resulting from dividing the unit time by a second target value. The second target value is the target value (the number of document sheets read per unit time as stated on the specification) at the second speed V2. For example, in a case where the unit time is one minute and the first target value is 100 sheets, 0.6 seconds is taken as the first productivity time. In a case where the second target value is 50 sheets, 1.2 seconds is taken as the second productivity time. The conveyance memory 50*b* may store productivity time data D2 in which are defined the first and second productivity times (see FIG. 2). In that case, the conveyance controller 50 refers to the productivity time data D2 to determine the intervals of secondary sheet feeding.

Figure 6:
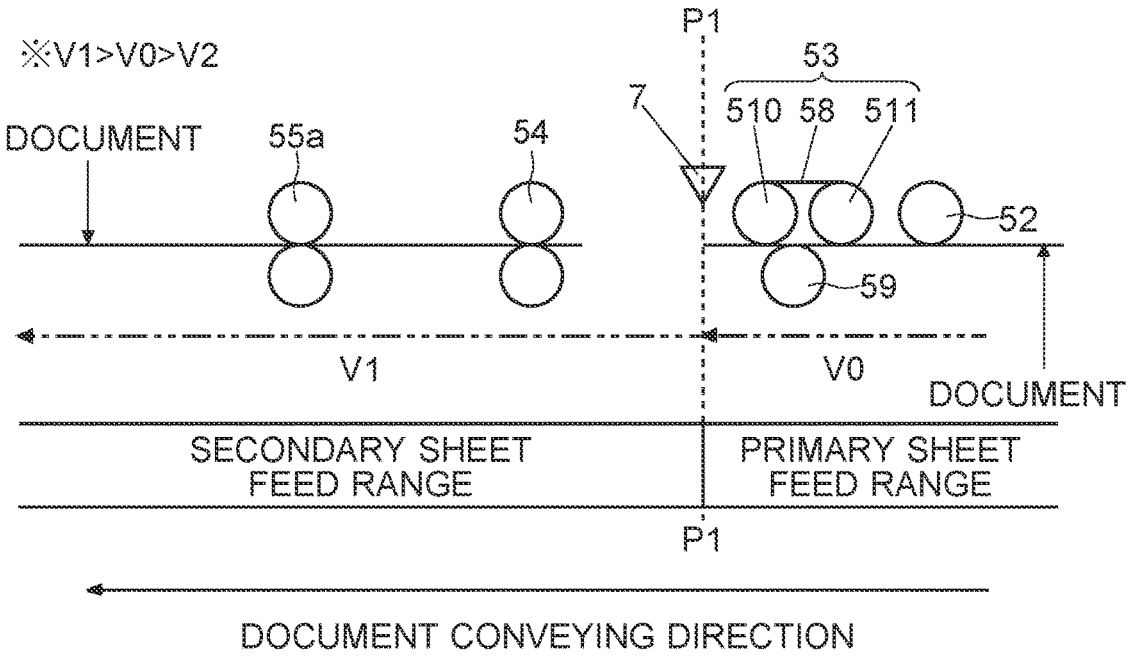
FIG. 6 is a diagram showing one example of document conveyance at a first speed according to the embodiment.
Figure 7:
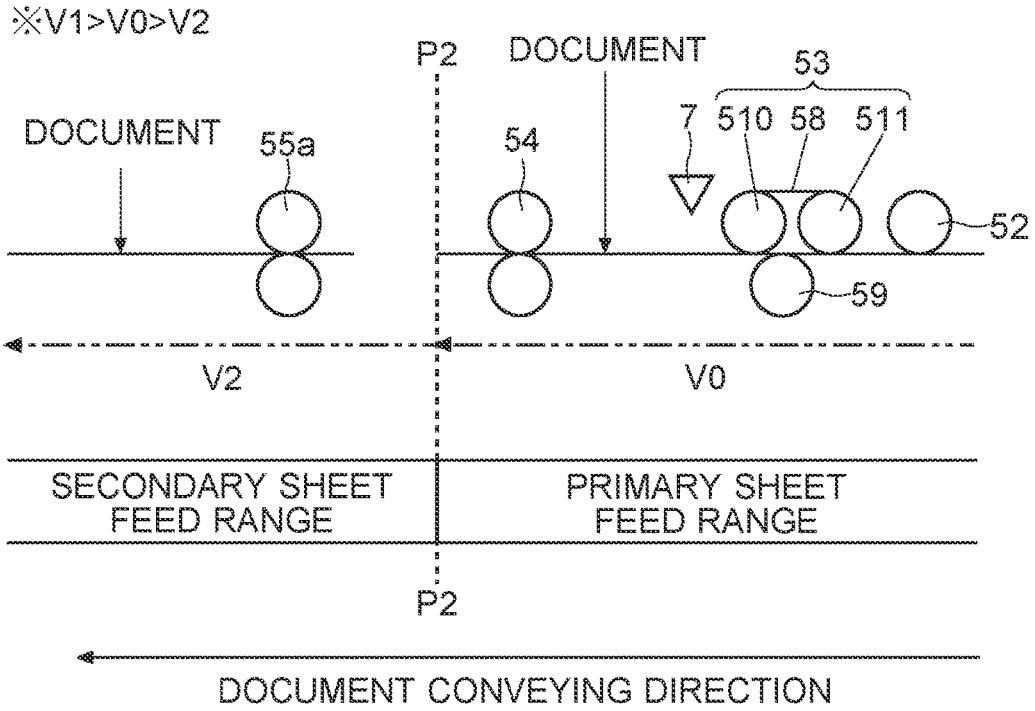
FIG. 7 is a diagram showing one example of document conveyance at a second speed according to the embodiment.

With reference to FIGS. 6 and 7, a description will be given of one example of the first stop position P1 (the position at which the leading end of a document sheet stops at the first speed V1) and the second stop position P2 (the position at which the leading end of a document sheet stops at the second speed V2). FIGS. 6 and 7 are diagrams schematically showing the positional relationship among the sheet feeding rotary members, the pair of secondary sheet feed rollers 54, and the feed sensor 7. In order from upstream in the document conveying direction, there are arranged the sheet feed roller 52 (sheet feeding rotary member) the sheet feed belt 58 (sheet feeding rotary member), the feed sensor 7, and the pair of secondary sheet feed rollers 54.

FIG. 6 shows one example of the first stop position P1. The first stop position P1 is a position between the sheet feeding rotary members and the pair of secondary sheet feed rollers 54. For example, when the secondary sheet feeding speed equals the first speed V1, the conveyance controller 50, on recognizing the leading end of a document sheet to have reached the feed sensor 7 in primary sheet feeding, may momentarily stop the sheet feeding rotary members. In this case, when the output of the feed sensor 7 turns to the level it exhibits on sensing the leading end of a document sheet, the conveyance controller 50 immediately stops the feed motor 5*a*. FIG. 6 shows an example where the document sense position of the feed sensor 7 is set as the first stop position P1. The first speed V1 is higher than the primary sheet feeding speed V0. From the perspective of productivity, it is advantageous to reduce the conveying distance in primary sheet feeding and increase the conveying distance in secondary sheet feeding. Accordingly, in the multifunctional peripheral 100, when the feed sensor 7 senses the leading end of a document sheet, primary sheet feeding is ended.

FIG. 7 shows one example of the second stop position P2. The second stop position P2 is a position downstream of the pair of secondary sheet feed rollers 54. For example, when the secondary sheet feeding speed equals the second speed V2, the conveyance controller 50, when a previously determined feed time D3 passes after recognizing the leading end of a document sheet to have reached the feed sensor 7 in primary sheet feeding, momentarily stops the sheet feeding rotary members. In this case, after the output of the feed sensor 7 turns to the level it exhibits on sensing the leading end of a document sheet, when the leading end of the document sheet moves to downstream of the pair of secondary sheet feed rollers 54, the conveyance controller 50 stops the feed motor 5*a*.

The feed time D3 is previously determined. For example, the feed time D3 is set equal to the time resulting from dividing the distance from the feed sensor 7 to the second stop position P2 by the primary sheet feeding speed V0. The conveyance memory 50*b* may store the feed time D3 on a nonvoluntary basis (see FIG. 2).

When feeding the leading end of a document sheet to downstream of the pair of secondary sheet feed rollers 54, the conveyance controller 50 may rotate the pair of secondary sheet feed rollers 54. In that case, the conveyance controller 50 rotates the pair of secondary sheet feed rollers 54 such that the document sheet is conveyed at the primary sheet feeding speed V0. The conveyance controller 50 stops simultaneously the sheet feed roller 52, the separating feeding portion 53 (sheet feed belt 58), and the pair of secondary sheet feed rollers 54.

FIG. 7 shows an example where the second stop position P2 is set downstream of the pair of secondary sheet feed rollers 54. The second speed V2 is lower than the primary sheet feeding speed V0. From the perspective of productivity, it is advantageous to increase the conveying distance in primary sheet feeding and to reduce the conveying distance in secondary sheet feeding. Accordingly, in the multifunctional peripheral 100, after the leading end of a document sheet has moved downstream of the pair of secondary sheet feed rollers 54, primary sheet feeding is ended. Here, the conveying speed of the document sheet has to be the secondary sheet feeding speed when it reaches the reverse-side reading unit 512. Accordingly the second stop position P2 is set at a position between the pair of secondary sheet feed rollers 54 and the pair of first document conveying rollers 55*a*. The second stop position P2 may instead be set downstream of the pair of secondary sheet feed rollers 54; even then a document sheet can be read properly.

Next, with reference to FIG. 8, a description will be given of one example of the flow of document conveyance in the registrationless mode with the secondary sheet feeding speed at the first speed V1. In the registrationless mode, irrespective of the secondary sheet feeding speed, the conveyance controller 50 keeps the pairs of document conveying rollers and the pair of document discharge rollers 56 rotating. That is, after the first document sheet starts to be fed out until the last document sheet is discharged, the conveyance controller 50 keeps the document conveying motor 5*c* and the document discharge motor 5*d* rotating such that document sheets are conveyed at the secondary sheet feeding speed.

Figure 8:
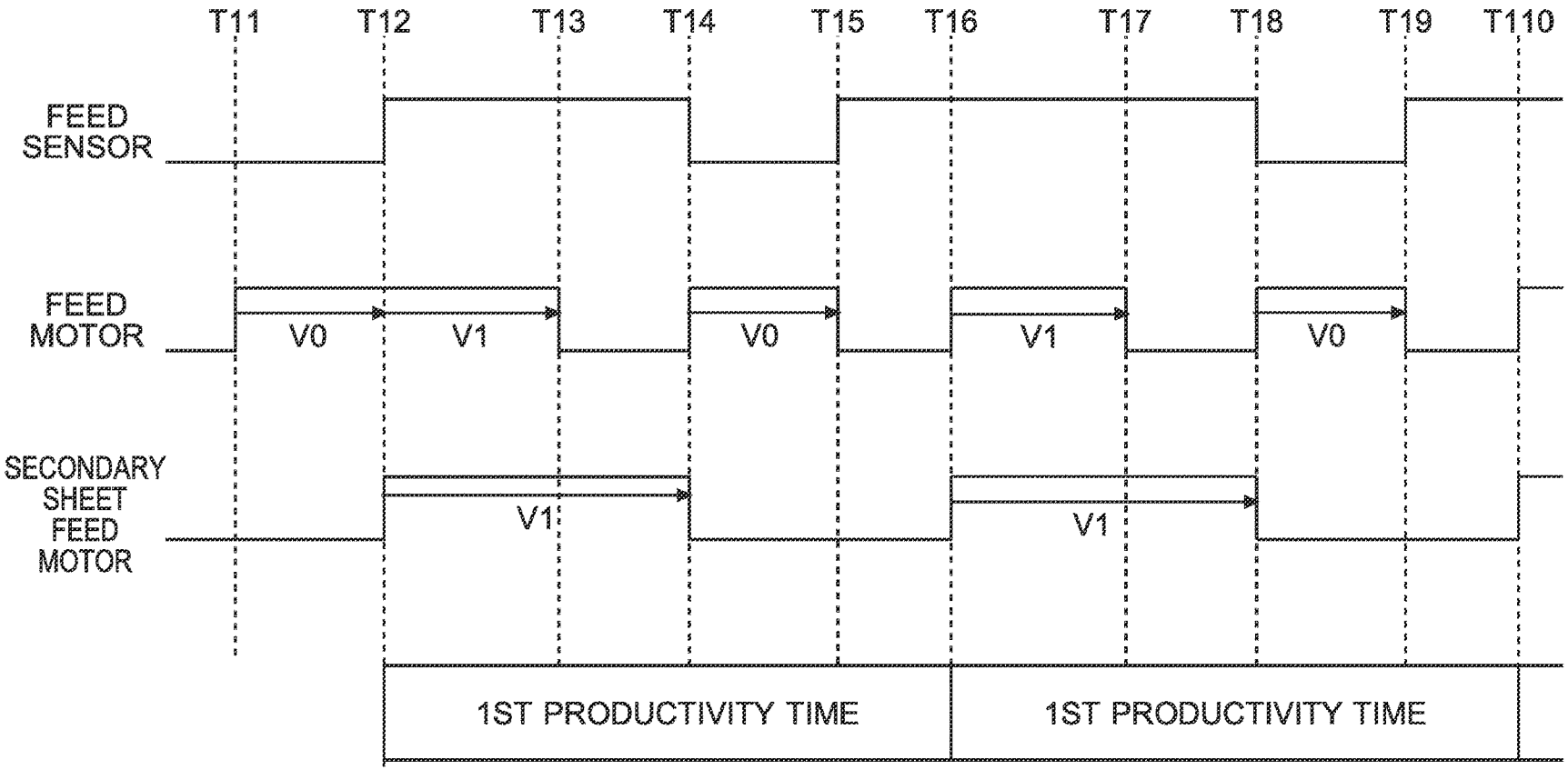
FIG. 8 is a diagram showing one example of document conveyance at the first speed according to the embodiment.

FIG. 8 shows, in the top tier, the output level of the feed sensor 7. In the example shown in FIG. 8, High level indicates that a document sheet is being sensed; Low level indicates that no document sheet is being sensed. A shift from Low level to High level marks the time point of the leading end of a document sheet being sensed to have arrived. A shift from High level to Low level marks the time point of the trailing end of the document sheet being sensed to have departed.

FIG. 8 shows, in the second-from-the-top tier, how the driving of the feed motor 5*a* (the sheet feed roller 52 and the separating feeding portion 53) is turned on and off. A High-level period is when the feed motor 5*a* is rotated; a Low-level period is when the feed motor 5*a* is left at a standstill. FIG. 8 shows, in the third-from-the-top tier, how the driving of the secondary sheet feed motor 5*b* (pair of secondary sheet feed rollers 54) is turned on and off. A High-level period is when the secondary sheet feed motor 5*b* is rotated; a Low-level period is when the secondary sheet feed motor 5*b* is left at standstill.

Time point T11 is when the feeding of the first document sheet is started. The conveyance controller 50 starts the rotation of the sheet feed roller 52 and the separating feeding portion 53 (sheet feed belt 58). The conveyance controller 50 starts to convey the document sheet at the primary sheet feeding speed V0. Time point T12 is when the leading end of the first document sheet is sensed by the feed sensor 7. With the first document sheet, on sensing the arrival of its leading end, the conveyance controller 50 immediately starts secondary sheet feeding. Time point T12 is also when secondary sheet feeding starts. In response to the start of secondary sheet feeding, the conveyance controller 50 also starts rotation of the pair of secondary sheet feed rollers 54. The conveyance controller 50 has the document sheet conveyed at the first speed V1.

The first speed V1 is higher than the primary sheet feeding speed V0. Accordingly, in response to the start of secondary sheet feeding, the conveyance controller 50 increases the rotation speed of the feed motor 5*a*. In response to the start of secondary sheet feeding, the conveyance controller 50 increases the rotation speeds of the sheet feed roller 52 and the separating feeding portion 53 such that the document sheet is conveyed at the first speed V1. The conveyance controller 50 starts to count the first productivity time at the time point of the start of secondary sheet feeding. The start of secondary sheet feeding thus triggers the counting of the first productivity time.

Time point T13 is when the rotation of the feed motor 5*a* is stopped. In response, the sheet feed roller 52 and the separating feeding portion 53 stop rotating. Keeping the feed motor 5*a* rotating may cause the next document sheet to be fed out with no interval from the preceding one. At the time point of the stop, the pair of secondary sheet feed rollers 54 and the pair of first document conveying rollers 55*a* are conveying a document sheet. Even with the feed motor 5*a* at standstill, the document sheet is conveyed.

Time point T14 is when the feed sensor 7 senses the departure of the trailing end of a document sheet. When the feed sensor 7 senses the departure of the trailing end, the conveyance controller 50 starts to rotate the feed motor 5*a*. In response, the sheet feed roller 52 and the separating feeding portion 53 start to rotate. The document conveying speed equals the primary sheet feeding speed V0. That is, the conveyance controller 50 starts to advance the next document sheet. As shown in FIG. 8, the conveyance controller 50 may stop the secondary sheet feed motor 5*b* (pair of secondary sheet feed rollers 54) at time point T14. The document sheet has been fed out far enough that one or more pairs of rollers are conveying the document sheet. Even with the secondary sheet feed motor 5*b* at a standstill, the document sheet is fed on.

Time point T15 is when the feed sensor 7 senses the leading end of the subsequent document sheet. With the second and any subsequent document sheet, when the feed sensor 7 senses the arrival of its leading end, the conveyance controller 50 stops the sheet feed roller 52 and the separating feeding portion 53. The leading end of the document sheet stops at the first stop position P1. When the first productivity time passes, the document sheet is fed further on from the first stop position P1.

Time point T16 is when the first productivity time has passed after the start of the previous secondary sheet feeding. Now, the conveyance controller 50 starts secondary sheet feeding. In response to the start of secondary sheet feeding, the conveyance controller 50 rotates the sheet feed roller 52, the separating feeding portion 53, the feed motor 5*a*, the pair of secondary sheet feed rollers 54, and the secondary sheet feed motor 5*b*. The conveyance controller 50 rotates those members such that the document sheet is conveyed at the first speed V1.

In preparation for the secondary sheet feeding of the next document sheet, the conveyance controller 50 resets the count of the first productivity time. Then the conveyance controller 50 starts to count the first productivity time from the time point of the start of secondary sheet feeding. Thereafter, the rotation of the sheet feed roller 52, the separating feeding portion 53, the feed motor 5*a*, the pair of secondary sheet feed rollers 54, and the secondary sheet feed motor 5*b* is started and stopped repeatedly so that secondary sheet feeding is started every time the first productivity time passes. After the start of secondary sheet feeding, time point T17 marks when the rotation of the sheet feed roller 52, the separating feeding portion 53, and the feed motor 5*a* is stopped (as at time point T13).

Time point T18 is when the feed sensor 7 senses the departure of the trailing end of the document sheet and the conveyance controller 50 starts the rotation of the sheet feed roller 52, the separating feeding portion 53, and the feed motor 5*a* while stopping the pair of secondary sheet feed rollers 54 and the secondary sheet feed motor 5*b* (as at time point T14). Time point T19 is when the feed sensor 7 senses the leading end of the subsequent document sheet and the conveyance controller 50 stops the sheet feed roller 52, the separating feeding portion 53, and the feed motor 5*a* (as at time point T15).

Time point T110 is when the first productivity time has passed after the start of the previous secondary sheet feeding. It is also when the conveyance controller 50 starts secondary sheet feeding and starts the rotation of the sheet feed roller 52, the separating feeding portion 53, the feed motor 5*a*, the pair of secondary sheet feed rollers 54, and the secondary sheet feed motor 5*b*. The conveyance controller 50 rotates those members such that the document sheet is conveyed at the first speed V1 (as at time point T16). As long as there are any document sheets left, the sequence of operation from time point T16 to time point T110 is repeated.

Figure 9:
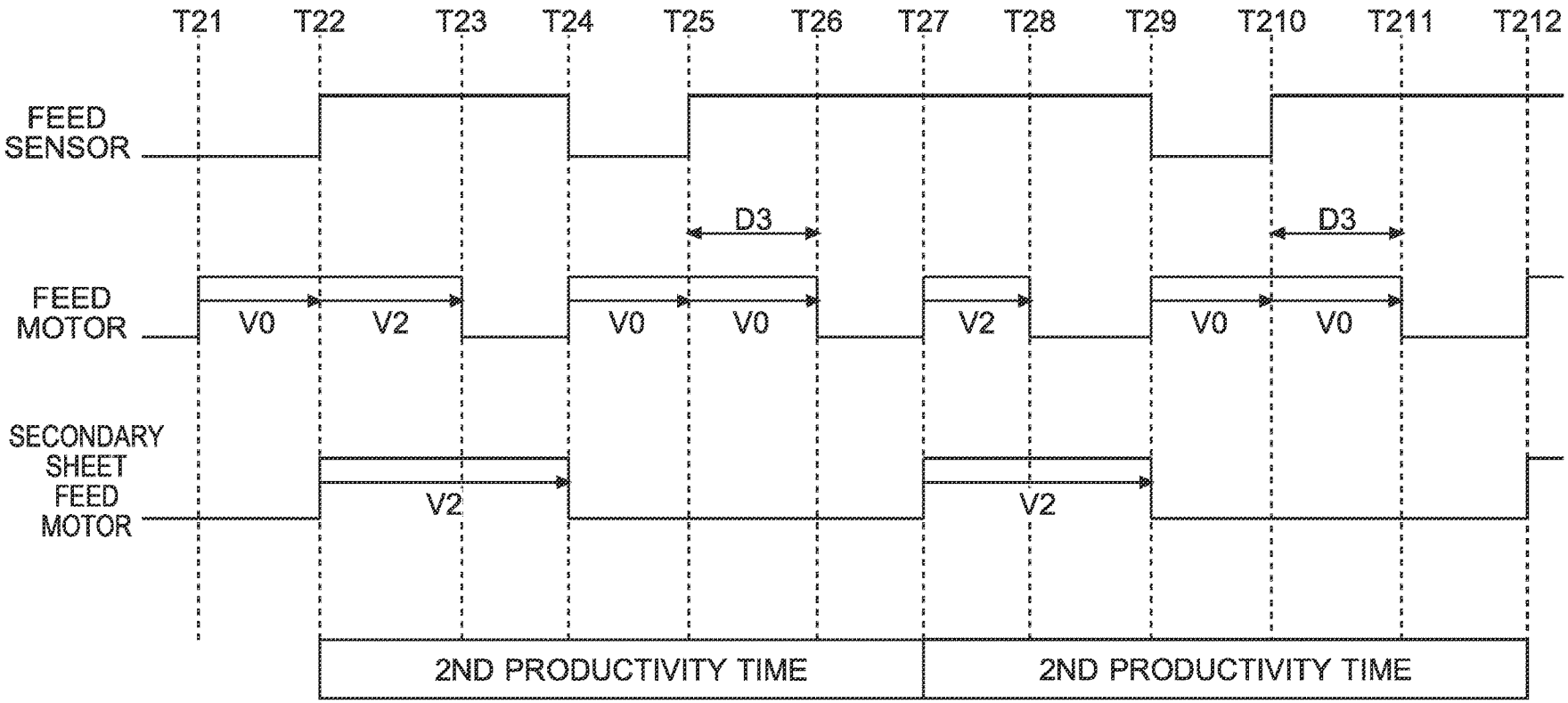
FIG. 9 is a diagram showing one example of document conveyance at the second speed according to the embodiment.

Next, with reference to FIG. 9, a description will be given of one example of the flow of document conveyance in the registrationless mode with the secondary sheet feeding speed at the second speed V2. FIG. 9 shows, in the top tier, the output level of the feed sensor 7 (as in FIG. 8). FIG. 9 shows, in the second-from-the-top tier, how the driving of the feed motor 5*a* (the sheet feed roller 52 and the separating feeding portion 53) is turned on and off (as in FIG. 8). FIG. 9 shows, in the third-from-the-top tier, how the driving of the secondary sheet feed motor 5*b* (pair of secondary sheet feed rollers 54) is turned on and off (as in FIG. 8).

Time point T21 is when the feeding of the first document sheet is started. The conveyance controller 50 starts the rotation of the sheet feed roller 52, the separating feeding portion 53, and the feed motor 5*a*. The conveyance controller 50 starts to convey the document sheet at the primary sheet feeding speed V0. Time point T22 is when the leading end of the first document sheet is sensed by the feed sensor 7. With the first document sheet, on sensing the arrival of its leading end, the conveyance controller 50 immediately starts secondary sheet feeding. In this respect, what takes place here is the same as when the secondary sheet feeding speed equals the first speed V1. Time point T22 is also when secondary sheet feeding starts. In response to the start of secondary sheet feeding, the conveyance controller 50 also starts the rotation of the pair of secondary sheet feed rollers 54 and the secondary sheet feed motor 5*b*. The conveyance controller 50 has the document sheet conveyed at the second speed V2.

The second speed V2 is lower than the primary sheet feeding speed V0. Accordingly, in response to the start of secondary sheet feeding, the conveyance controller 50 may reduce the rotation speed of the feed motor 5*a*. The purpose is to prevent the document sheet from sagging inside the document conveyance passage. In response to the start of secondary sheet feeding, the conveyance controller 50 adjusts the rotation speed of the feed motor 5*a* so that the document sheet is conveyed at the second speed V2. The conveyance controller 50 starts to count the second productivity time from the time point of the start of secondary sheet feeding. The start of secondary sheet feeding thus triggers the counting of the second productivity time. Thereafter, the conveyance controller 50 starts secondary sheet feeding at every period of the second productivity time.

Time point T23 is when the rotation of the feed motor 5*a* is stopped. In response, the sheet feed roller 52 and the separating feeding portion 53 stops rotating. Keeping the feed motor 5*a* rotating may cause the next document sheet to be fed out with no interval from the preceding one. Now at least one pair of rollers downstream of the pair of secondary sheet feed rollers 54 has started conveying the document sheet, and thus even with the feed motor 5*a* at standstill, the document sheet is conveyed.

Time point T24 is when the feed sensor 7 senses the passage of the trailing end of a document sheet. When the feed sensor 7 senses the passage of the trailing end, the conveyance controller 50 starts the rotation of the sheet feed roller 52 and the separating feeding portion 53. In response, the sheet feed roller 52 and the separating feeding portion 53 start to rotate. The document conveying speed equals the primary sheet feeding speed V0. Thus, the conveyance controller 50 starts to convey the next document sheet. As shown in FIG. 9, the conveyance controller 50 may stop the secondary sheet feed motor 5*b* at time point T24. One or more pairs of document conveying rollers are conveying the document sheet. Even with the secondary sheet feed motor 5*b* at a standstill, the document sheet is fed on.

Time point T25 is when the feed sensor 7 senses the leading end of the subsequent document sheet. Unlike when the secondary sheet feeding speed equals the first speed V1, even on recognizing the arrival of the leading end at the feed sensor 7, the conveyance controller 50 does not stop the sheet feed roller 52 and the separating feeding portion 53. After recognizing the arrival of the leading end of the document sheet based on the feed sensor 7, the conveyance controller 50 keeps rotating the sheet feed roller 52, the separating feeding portion 53, and the feed motor 5*a* for the feed time D3. The purpose is to feed the document sheet up to the second stop position P2. After the additional conveyance for the feed time D3, the conveyance controller 50 stops the sheet feed roller 52 and the separating feeding portion 53 (time point T26). Thus the leading end of the document sheet is fed to a position downstream of the pair of secondary sheet feed rollers 54.

During the feed time D3, the conveyance controller 50 may rotate the pair of secondary sheet feed rollers 54. The purpose is to feed a downstream-side end part of the document sheet to downstream of the pair of secondary sheet feed rollers 54. In this case, the conveyance controller 50 rotates the pair of secondary sheet feed rollers 54 and the secondary sheet feed motor 5*b* at the primary sheet feeding speed V0. After conveyance corresponding to the feed time D3, the conveyance controller 50 stops also the pair of secondary sheet feed rollers 54.

Time point T27 is when the second productivity time has passed after the start of the previous secondary sheet feeding. Now the conveyance controller 50 starts secondary sheet feeding. In response to the start of secondary sheet feeding, the conveyance controller 50 rotates the sheet feed roller 52, the separating feeding portion 53, the feed motor 5*a*, the pair of secondary sheet feed rollers 54, and the secondary sheet feed motor 5*b*. The conveyance controller 50 rotates those members such that the document sheet is conveyed at the second speed V2. Moreover, in preparation to the subsequent secondary sheet feeding, the conveyance controller 50 resets the count of the second productivity time. Then the conveyance controller 50 starts to count the second productivity time from the start of secondary sheet feeding.

Thereafter, the rotation of the sheet feed roller 52, the separating feeding portion 53, the feed motor 5*a*, the pair of secondary sheet feed rollers 54, and the secondary sheet feed motor 5*b* is started and stopped so that secondary sheet feeding is started every time the second productivity time passes. Time point T28 is when the rotation of the sheet feed roller 52, the separating feeding portion 53, and the feed motor 5*a* is stopped (as at time point T23).

Time point T29 is when the feed sensor 7 senses the departure of the trailing end of the document sheet and the conveyance controller 50 starts the rotation of the sheet feed roller 52, the separating feeding portion 53, and the feed motor 5*a* while stopping the rotation of the pair of secondary sheet feed rollers 54 and the secondary sheet feed motor 5*b* (as at time point T24). Time point T210 is when the feed sensor 7 senses the arrival of the leading end of the subsequent document sheet (as at time point T25).

When the secondary sheet feeding speed equals the second speed V2, even with the second or any subsequent document sheet, the conveyance controller 50 does not, on sensing the arrival of the leading end at the feed sensor 7 (at time point T210), stop the sheet feed roller 52, the separating feeding portion 53, and the feed motor 5*a*. After recognizing the arrival of the leading end of the document sheet based on the output of the feed sensor 7, the conveyance controller 50 rotates the sheet feed roller 52, the separating feeding portion 53, and the feed motor 5*a* for the feed time D3. After conveyance corresponding to the feed time D3, the conveyance controller 50 stops the sheet feed roller 52, the separating feeding portion 53, and the feed motor 5*a*. Time point T211 is when the sheet feed roller 52, the separating feeding portion 53, and the feed motor 5*a* are stopped.

Even with the second or any subsequent document sheet, during the feed time D3, the conveyance controller 50 may rotate the pair of secondary sheet feed rollers 54. In that case, the conveyance controller 50 rotates the pair of secondary sheet feed rollers 54 at the primary sheet feeding speed V0. Then, at time point T211, the conveyance controller 50 stops the pair of secondary sheet feed rollers 54.

To perform secondary sheet feeding with a constant rhythm, the conveyance controller 50 waits for the passage of the second productivity time. Time point T212 is when the second productivity time has passed after the start of the previous secondary sheet feeding. Now the conveyance controller 50 starts secondary sheet feeding. In response to the start of secondary sheet feeding, the conveyance controller 50 rotates the sheet feed roller 52, the separating feeding portion 53, the feed motor 5*a*, the pair of secondary sheet feed rollers 54, and the secondary sheet feed motor 5*b*. The conveyance controller 50 rotates those members such that the document sheet is conveyed at the second speed V2 (as at time point T27). As long as there are any document sheets left, the sequence of operation from time point t27 to time point T212 is repeated.

(Secondary Sheet Feeding at Third Speed)

Next, a description will be given of secondary sheet feeding at the third speed on the multifunctional peripheral 100 according to the embodiment. The multifunctional peripheral 100 has, as the secondary sheet feeding speed, not only the first speed V1 and the second speed V2 but also the third speed (see FIG. 5). That is, in conveyance after secondary sheet feeding, the conveyance controller 50 occasionally rotates the feed motor 5*a*, the secondary sheet feed motor 5*b*, the document conveying motor 5*c*, and the document discharge motor 5*d* such that the document sheet is fed at the third speed.

When the secondary sheet feeding speed equals the third speed, in primary sheet feeding, the conveyance controller 50 momentarily stops the sheet feeding rotary members such that the leading end of the document sheet stops at the third stop position. Here, the third speed is lower than the first speed V1 but higher than the second speed V2. That is, the speeds have the relationship First Speed V1>Third Speed>Second Speed V2.

Accordingly, when the secondary sheet feeding speed equals the third speed, the conveyance controller 50 may, in primary sheet feeding, momentarily stop the sheet feeding rotary members such that the leading end of the document sheet stops at the first stop position P1. That is, the third stop position may be at the same position as the first stop position P1. In that case, operation similar to that in FIG. 8 is performed. Moreover, when the secondary sheet feeding speed equals the third speed, the conveyance controller 50 may, in primary sheet feeding, momentarily stop the sheet feeding rotary members such that the leading end of the document sheet stops at the second stop position P2. That is, the third stop position may be at the same position as the second stop position P2. In that case, operation similar to that in FIG. 9 is performed.

That is, in a case where the secondary sheet feeding speed has three or more alternatives, the conveyance controller 50 may, in primary sheet feeding, momentarily stop the sheet feeding rotary members such that the leading end of the document sheet stops at one of the first and second stop positions P1 and P2. Even in a case where the secondary sheet feeding speed has a number of alternatives, they can be handled with a few patterns of operation. This helps avoid complicating development and designing.

Moreover, when the secondary sheet feeding speed equals the third speed, the conveyance controller 50 may, in primary sheet feeding, momentarily stop the sheet feeding rotary members such that the leading end of the document sheet stops at a position between the first and second stop positions P1 and P2. That is, the conveyance controller 50 may use a different stop position for each alternative of the secondary sheet feeding speed. The conveyance controller 50 may set the stop position farther downstream in the document conveying direction the lower the secondary sheet feeding speed.

As described above, a document conveying device (multifunctional peripheral 100) according to an embodiment includes a document tray 51, a sheet feeding rotary member (sheet feed roller 52, separating feeding portion 53), a secondary sheet feeding roller (pair of secondary sheet feed rollers 54), and a controller (conveyance controller 50). On the document tray 51, a document is set. The sheet feeding rotary member feeds a document sheet out of the document set on the document tray 51. The pair of secondary sheet feed rollers 54 is provided downstream of the sheet feeding rotary member in the document conveying direction. The pair of secondary sheet feed rollers 54 feeds the document sheet toward the reading position. The controller controls the rotation of the sheet feeding rotary member and the pair of secondary sheet feed rollers 54. When feeding one document sheet after another out of the document set on the document tray 51 toward the reading position, the controller, in primary sheet feeding, rotates the sheet feeding rotary member such that the document sheet is fed at a primary sheet feeding speed V0, and momentarily stops the sheet feeding rotary member before the trailing end of the document sheet leaves the sheet feeding rotary member. In secondary sheet feeding after momentarily stopping the sheet feeding rotary member, the controller rotates the sheet feeding rotary member and the pair of secondary sheet feed rollers 54 such that the document sheet is fed at a secondary sheet feeding speed different from the primary sheet feeding speed V0. The secondary sheet feeding speed can be a first speed V1 or a second speed V2 lower than the first speed V1. When the secondary sheet feeding speed equals the first speed V1, in primary sheet feeding, the controller momentarily stops the sheet feeding rotary member such that the leading end of the document sheet stops at a first stop position P1. When the secondary sheet feeding speed equals the second speed V2, in primary sheet feeding, the controller momentarily stops the sheet feeding rotary member such that the leading end of the document sheet stops at a second stop position P2. The second stop position P2 is located downstream of the first stop position P1 in the document conveying direction.

When the secondary sheet feeding speed is high (first speed V1), the document sheet can be stopped at the first stop position P1 before secondary sheet feeding is started. The first stop position P1 is upstream of the second stop position P2 in the document conveying direction. Document conveyance can be started at the high speed (first speed V1) earlier. The document sheet can thus be fed to the reading position in time.

On the other hand, when the secondary sheet feeding speed is low (second speed V2), the document sheet can be advanced to the second stop position P2 before secondary sheet feeding is started. The second stop position P2 is downstream of the first stop position P1 in the document conveying direction. The document sheet can be advanced as much as possible before document conveyance is started at the second speed V2. Even if the secondary sheet feeding speed is somewhat low, the document sheet can be fed to the reading position without delay. Moreover, irrespective of the document conveying speed, the document sheet can be delivered to the reading position not too early but without delay. The document sheet can be delivered to the reading position well in time. Thus, even if some slip occurs on a roller that feeds it, the document sheet can be conveyed so as to attain the set number of sheets read per unit time. It is thus possible to secure high productivity.

The document conveying device (multifunctional peripheral 100) may include a pair of document conveying rollers (pair of first document conveying rollers 55*a*, pair of second document conveying rollers 55*b*, pair of third document conveying rollers 55*c*) provided downstream of the pair of secondary sheet feed rollers 54. The controller may have the document sheet conveyed without thrusting the leading end of the document sheet against either the pair of secondary sheet feed rollers 54 roller or the pair of document conveying rollers and thus without correcting skewed feeding. Conventionally, for correction of skewed feeding, a document sheet is thrust against a pair of registration rollers to make it sag. The above structure helps spare thrusting a document sheet to make it sag. Correcting skewed feeding requires comparatively long time to stop a document sheet and make it sag sufficiently. Sparing operation for correction of skewed feeding helps reduce conveying time per document sheet irrespective of the document conveying speed. Document sheets can be read quickly, and it is possible to achieve a document conveying speed that promises high productivity.

The document conveying device (multifunctional peripheral 100) may include an operation panel 3 that accepts setting. When the operation panel 3 accepts choice of a registration mode, the controller may rotate the pair of secondary sheet feed rollers 54 after thrusting the leading end of the document sheet against the pair of secondary sheet feed rollers 54 to make the document sheet sag and thereby correcting skewed feeding. When the operation panel 3 accepts choice of a registrationless mode, the controller may have the document sheet conveyed without thrusting the leading end of the document sheet against either the pair of secondary sheet feed rollers 54 or the pair of document conveying rollers and thus without correcting skewed feeding. Whether to correct skewed feeding or not can be chosen. A user who wants fast document reading can choose not to correct skewed feeding. A user who wants image data without skew while tolerating somewhat slow reading speed can choose to correct skewed feeding. The user can make a choice to have desired operation performed. It is possible to provide a user-friendly document conveying device.

The pair of secondary sheet feed rollers 54 may be the first conveying rotary member downstream of the sheet feeding rotary member in the document conveying direction. The sheet feeding rotary member and the pair of secondary sheet feed rollers 54 are located near each other, and thus, in secondary sheet feeding, a document sheet can be fed downstream smoothly. A long distance can be secured between the stop position and the reading position, and this permits a document sheet to reach the reading position after sufficient acceleration.

The first stop position P1 may be a position between the sheet feeding rotary member and the pair of secondary sheet feed rollers 54. The second stop position P2 may be a position downstream of the pair of secondary sheet feed rollers 54 in the document conveying direction. The first and second stop positions P1 and P2 can be set apart across a distance that suits the secondary sheet feeding speed.

The document conveying device (multifunctional peripheral 100) may include a feed sensor 7. The feed sensor 7 is provided downstream of the sheet feeding rotary member in the document conveying direction, upstream of the pair of secondary sheet feed rollers 54 in the document conveying direction. The feed sensor 7 senses arrival of the leading end, and departure of the trailing end, of the document sheet fed by the sheet feeding rotary member. The controller recognizes, based on the output of the feed sensor 7, arrival at it of the leading end, and departure from it of the trailing end, of the document sheet. When the secondary sheet feeding speed equals the first speed V1, in primary sheet feeding, the controller momentarily stops the sheet feeding rotary member on recognizing arrival of the leading end of the document sheet at the feed sensor 7. When the secondary sheet feeding speed equals the second speed V2, in primary sheet feeding, the controller momentarily stops the sheet feeding rotary member when a previously determined feed time D3 passes after recognizing arrival of the leading end of the document sheet at the feed sensor 7. The spot at which the feed sensor 7 senses the leading end of the document sheet can be taken as the first stop position P1. When secondary sheet feeding is performed at the first speed V1, a shift to document conveyance at the first speed V1 can be made promptly. When secondary sheet feeding is performed at the second speed V2, the document sheet can be fed sufficiently downstream before document conveyance at the second speed V2 is started. Even at a low document conveying speed, the document sheet can be fed to the reading position in time. The document sheet can be conveyed so as to attain the target value of the number of sheets read per unit time (with no drop in productivity).

The controller may count time. When the secondary sheet feeding speed equals the first speed V1, the controller starts secondary sheet feeding every time a first productivity time passes. When the secondary sheet feeding speed equals the second speed V2, the controller starts secondary sheet feeding every time a second productivity time passes. The first productivity time is shorter than the second productivity time. Secondary sheet feeding can be started at constant intervals. Document sheets can be conveyed at a constant number of sheets read per unit time.

Let the target value of the number of document sheets read per unit time at the first speed V1 be the first target value, and let the target value of the number of document sheets read per unit time at the second speed V2 be the second target value. Then the controller takes as the first productivity time the time resulting from dividing the unit time by the first target value, and takes as the second productivity time the time resulting from dividing the unit time by the second target value. Secondary sheet feeding can be started so as to attain, but not to exceed, the target value of the number of sheets read per unit time (the target number of sheets read). Secondary sheet feeding can be started with a constant rhythm.

The document conveying device (multifunctional peripheral 100) may include an operation panel 3 that accepts setting. In a job involving document reading, the controller determines the secondary sheet feeding speed based on a setting made on the operation panel 3 with respect to document reading. When the document sheet can be fed to the reading position earlier when conveyed at the primary sheet feeding speed V0, the conveying time (conveying distance) at the primary sheet feeding speed V0 can be made longer. The document sheet can be fed downward as much as possible at the primary sheet feeding speed V0 before secondary sheet feeding at the second speed V2 is started. Even at a not so high second speed V2, the document sheet can be conveyed so as to attain the number of sheets (the target value) read per unit time as stated on the specification.

The secondary sheet feeding speed may have three or more alternatives. In this case, the controller may determine, for each alternative of the secondary sheet feeding speed, the stop position at which to stop the leading end of the document sheet when momentarily stopping the sheet feeding rotary member (sheet feed roller 52, separating feeding portion 53), preferably such that, the lower the secondary sheet feeding speed, the farther downstream in the document conveying direction the stop position is located. The lower the secondary sheet feeding speed, the farther downstream in the document conveying direction the document sheet can be fed during primary sheet feeding. The document sheet can be conveyed so as to attain the number of sheets (the target value) read per unit time as stated on the specification (with no drop in productivity).

When the secondary sheet feeding speed equals a third speed, in primary sheet feeding, the controller may momentarily stop the sheet feeding rotary member such that the leading end of the document sheet stops at the first stop position P1 or stop the sheet feeding rotary member such that the leading end of the document sheet stops at the second stop position P2. Here, the third speed may be lower than the first speed but higher than the second speed.

Any embodiments disclosed herein are in every aspect illustrative and not restrictive. The scope of the present disclosure is defined not by the embodiments described above but by the appended claims, and encompasses any modifications made in a sense and scope equivalent to the claims.

What is claimed is:

1. A document conveying device, comprising:

a document tray on which a document is set;

a sheet feeding rotary member that feeds a document sheet out of the document set on the document tray;

a secondary sheet feeding roller provided downstream of the sheet feeding rotary member in a document conveying direction, the secondary sheet feeding roller feeding the document sheet toward a reading position; and a controller that controls rotation of the sheet feeding rotary member and the secondary sheet feeding roller, wherein when one document sheet after another is fed out of the document set on the document tray toward the reading position, in primary sheet feeding, the controller rotates the sheet feeding rotary member such that the document sheet is fed at a primary sheet feeding speed, and momentarily stops the sheet feeding rotary member before a trailing end of the document sheet leaves the sheet feeding rotary member, in secondary sheet feeding after momentarily stopping the sheet feeding rotary member, the controller rotates the sheet feeding rotary member and the secondary sheet feeding roller such that the document sheet is fed at a secondary sheet feeding speed different from the primary sheet feeding speed, the secondary sheet feeding speed can be a first speed or a second speed lower than the first speed, when the secondary sheet feeding speed equals the first speed, in the primary sheet feeding, the controller momentarily stops the sheet feeding rotary member such that a leading end of the document sheet stops at a first stop position, when the secondary sheet feeding speed equals the second speed, in the primary sheet feeding, the controller momentarily stops the sheet feeding rotary member such that the leading end of the document sheet stops at a second stop position, and the second stop position is located downstream of the first stop position in the document conveying direction.

2. The document conveying device according to claim 1, further comprising:

a pair of document conveying rollers provided downstream of the secondary sheet feeding roller, wherein the controller has the document sheet conveyed without thrusting the leading end of the document sheet against either the secondary sheet feeding roller or the pair of document conveying rollers and thus without correcting skewed feeding.

3. The document conveying device according to claim 2, further comprising:

an operation panel that accepts setting, wherein when the operation panel accepts choice of a registration mode, the controller rotates the secondary sheet feeding roller after thrusting the leading end of the document sheet against the secondary sheet feeding roller to make the document sheet sag and thereby correcting skewed feeding, and when the operation panel accepts choice of a registrationless mode, the controller has the document sheet conveyed without thrusting the leading end of the document sheet against either the secondary sheet feeding roller or the pair of document conveying rollers and thus without correcting skewed feeding.

4. The document conveying device according to claim 1, wherein the secondary sheet feeding roller is a first conveying rotary member downstream of the sheet feeding rotary member in the document conveying direction.

5. The document conveying device according to claim 1, wherein the first stop position is a position between the sheet feeding rotary member and the secondary sheet feeding roller, and the second stop position is a position downstream of the secondary sheet feeding roller in the document conveying direction.

6. The document conveying device according to claim 1, further comprising:

a feed sensor provided downstream of the sheet feeding rotary member in the document conveying direction, upstream of the secondary sheet feeding roller in the document conveying direction, wherein the feed sensor senses arrival of a leading end, and departure of a trailing end, of the document sheet fed by the sheet feeding rotary member, the controller recognizes, based on an output of the feed sensor, arrival thereat of the leading end, and departure therefrom of the trailing end, of the document sheet, when the secondary sheet feeding speed equals the first speed, in the primary sheet feeding, the controller momentarily stops the sheet feeding rotary member on recognizing arrival of the leading end of the document sheet at the feed sensor, and when the secondary sheet feeding speed equals the second speed, in the primary sheet feeding, the controller momentarily stops the sheet feeding rotary member when a previously determined feed time passes after recognizing arrival of the leading end of the document sheet at the feed sensor.

7. The document conveying device according to claim 1, wherein the controller counts time, when the secondary sheet feeding speed equals the first speed, the controller starts the secondary sheet feeding every time a first productivity time passes, when the secondary sheet feeding speed equals the second speed, the controller starts the secondary sheet feeding every time a second productivity time passes, and the first productivity time is shorter than the second productivity time.

8. The document conveying device according to claim 7, wherein a first target value is a target value of a number of document sheets read per unit time at the first speed and a second target value is a target value of the number of document sheets read per unit time at the second speed, then the controller takes as the first productivity time a time resulting from dividing the unit time by the first target value, and takes as the second productivity time a time resulting from dividing the unit time by the second target value.

9. The document conveying device according to claim 1, further comprising:

an operation panel that accepts setting, wherein in a job involving document reading, the controller determines the secondary sheet feeding speed based on a setting made on the operation panel with respect to document reading.

10. The document conveying device according to claim 1, wherein the secondary sheet feeding speed has three or more alternatives, and the controller determines, for each alternative of the secondary sheet feeding speed, a stop position at which to stop a leading end of the document sheet when momentarily stopping the sheet feeding rotary member such that, the lower the secondary sheet feeding speed, the farther downstream in the document conveying direction the stop position is located.

11. The document conveying device according to claim 1, wherein when the secondary sheet feeding speed equal a third speed, in the primary sheet feeding, the controller momentarily stops the sheet feeding rotary member such that a leading end of the document sheet stops at the first stop position or stops the sheet feeding rotary member such that the leading end of the document sheet stops at the second stop position, and the third speed is lower than the first speed but higher than the second speed.

12. A method of controlling a document conveying device, the method including:

setting a document on a document tray;

feeding a document sheet out of the document set on the document tray with a sheet feeding rotary member;

feeding the document sheet toward a reading position with a secondary sheet feeding roller provided downstream of the sheet feeding rotary member in a document conveying direction;

when feeding one document sheet after another out of the document set on the document tray toward the reading position, in primary sheet feeding, rotating the sheet feeding rotary member such that the document sheet is fed at a primary sheet feeding speed;

momentarily stopping the sheet feeding rotary member before a trailing end of the document sheet leaves the sheet feeding rotary member;

in secondary sheet feeding after momentarily stopping the sheet feeding rotary member, rotating the sheet feeding rotary member and the secondary sheet feeding roller such that the document sheet is fed at a secondary sheet feeding speed different from the primary sheet feeding speed;

the secondary sheet feeding speed being a first speed or a second speed lower than the first speed;

when the secondary sheet feeding speed equals the first speed, in the primary sheet feeding, momentarily stopping the sheet feeding rotary member such that a leading end of the document sheet stops at a first stop position;

when the secondary sheet feeding speed equals the second speed, in the primary sheet feeding, momentarily stopping the sheet feeding rotary member such that the leading end of the document sheet stops at a second stop position; and the second stop position being located downstream of the first stop position in the document conveying direction.

* * * * *